United States Patent [19]

Farrell et al.

[11] Patent Number: 4,786,844

[45] Date of Patent: Nov. 22, 1988

[54] WIRE ION PLASMA GUN

[75] Inventors: Sherman R. Farrell, Orinda; Richard R. Smith, Pleasant Hill, both of Calif.

[73] Assignee: RPC Industries, Hayward, Calif.

[21] Appl. No.: 31,618

[22] Filed: Mar. 30, 1987

[51] Int. Cl.[4] ..... H01J 7/24

[52] U.S. Cl. ..... 315/111.21; 315/111.41; 315/111.81; 315/111.91; 315/39; 315/111.31; 313/363.1

[58] Field of Search ..... 315/39, 111.41, 111.21, 315/111.81, 111.9; 313/363, 364, 231.31

[56] References Cited

U.S. PATENT DOCUMENTS

| | | | |
|---|---|---|---|
| 3,243,570 | 3/1966 | Boring . | |
| 3,411,035 | 11/1968 | Necker et al. . | |
| 3,863,163 | 1/1975 | Farrell et al. . | |
| 3,866,089 | 2/1975 | Hengartner . | |
| 3,903,891 | 9/1975 | Brayshaw . | |
| 3,970,892 | 7/1976 | Wakalopulos | 315/111.31 |
| 4,019,091 | 4/1977 | Schoenmakers | 315/111.81 |
| 4,061,944 | 12/1977 | Gay . | |
| 4,143,272 | 3/1979 | Frank . | |
| 4,359,667 | 11/1982 | Paterson et al. . | |
| 4,450,031 | 5/1984 | Ono et al. | 156/345 |
| 4,458,180 | 7/1984 | Sohval et al. | 315/111.81 |
| 4,570,106 | 2/1986 | Sohval et al. | 315/111.81 |
| 4,642,522 | 2/1987 | Harvey et al. | 315/111.91 |
| 4,645,978 | 2/1987 | Harvey et al. | 313/567 |
| 4,694,222 | 9/1987 | Wakalopulos | 315/111.81 |

OTHER PUBLICATIONS

Bayless et al., "The Plasma-Cathode Electron Gun," IEEE Jour. Quantum Electronics, vol. QE-10, No. 2, pp. 213-218, Feb. 1974.

Zakharchenko et al., "A Stabilisation Unit for a Cold Cathode Glow Discharge Electron-Beam Gun," Auto. Weld. (GB) vol. 28, No. 12, pp. 56-58, Dec. 1975.

*Primary Examiner*—David K. Moore
*Assistant Examiner*—Michael Razavi
*Attorney, Agent, or Firm*—Malcolm B. Wittenberg

[57] ABSTRACT

An ion plasma electron gun for the generation of electron beams which exhibits electron beam dose uniformity and which is capable of varying the dose received by a material to be irradiated. Positive ions generated by a wire in a plasma discharge chamber are accelerated through an extraction grid onto a second chamber containing a high voltage cold cathode. These positive ions bombard a surface of the cathode, causing the cathode to emit secondary electrons which form an electron beam. After passing through the extraction grid in the plasma discharge chamber, the electron beam exits from the gun by way of a second grid and a foil window supported on the second grid. The gun is constructed so that the electron beam passing through the foil window has a relatively large area and uniform electron distribution which is subsantially the same as the ion distribution of the ion beam impinging upon the cathode. Means are provided for creating a pulse of secondary electrons by varying the period of time in which the secondary electrons are transmitted through the foil.

9 Claims, 6 Drawing Sheets

WIRE ION PLASMA GUN

BACKGROUND OF THE INVENTION

The ion plasma electron gun of the present invention is of the same general type as the gun disclosed in U.S. Pat. No. 3,970,892, and U.S. patent application Ser. No. 596,093. As disclosed in the cited patent and patent application, a recent advance in the art of generating high energy electron beams for use, for example, in e-beam excited gas lasers, is the plasma cathode electron gun. In such an electron gun a plasma is produced in a hollow cathode discharge between the hollow cathode surface and an anode grid operated at a relatively low voltage with respect to the cathode. Electrons are extracted from the discharge plasma through the anode grid and a control grid, and these electrons are accelerated to high energies in a plasma-free region between the grids and an accelerating anode which, typically, is a thin foil window maintained at a relatively high voltage with respect to the cathode. Among the advantages of the plasma cathode electron gun are its structural simplicity and ruggedness, high controllability and efficiency, low cost, and suitability for producing large area electron beams.

The electron guns disclosed in U.S. Pat. Nos. 3,970,892 as well as 4,025,818 have beams with electron distribution which is generally peaked in the center and diminished to zero at the edges of the foil windows. The device disclosed and claimed in U.S. patent application Ser. No. 596,093 depicts an advance in the art by providing an improved structure which generates an electron beam with uniform electron distribution across the entire beam as it emerges from the foil window.

In employing prior art electron beam generators, it has been recognized that beam uniformity is essentially independent of beam intensity. The beam current is proportional to the high voltage power supply current. Thus, controlling the dose rate of electrons bombarding a moving web to be irradiated is simply a question of measuring and controlling the current supplied by the high voltage power supply. In the case of wire ion plasma devices such as those disclosed in U.S. Pat. No. 3,970,892, the high voltage power supply current is the sum of incident helium ions and emitted electrons. The ratio of emitted electrons to incident ions, the secondary emission coefficient, is dependent upon surface conditions on the emitter surface. In view of the fact that these conditions appear to be changeable, simply monitoring the high voltage power supply is inadequate for controlling the dose rate of secondary electrons striking the moving web surface.

In further considering wire ion plasma devices, if one excludes the option of mechanically varying the grid between the plasma chamber and the high voltage emitting electrode, the instantaneous beam intensity of secondary electrons can only be varied by changing the intensity of the plasma discharge and thus the helium ion current. It has been found, however, that varying the plasma current over a factor of two up or down shows a significant undesirable change in beam uniformity as the plasma intensity is varied.

It is thus an object of the present invention to provide a device and method for its operation to enable one to vary the secondary electron beam intensity while maintaining uniformity in the secondary electron beam output. It is a further object of the present invention to provide a means for varying the dose rate of secondary electrons transmitted through a wire ion plasma device striking a moving or stationary web of material while maintaining secondary electron beam intensity over the entire surface of said moving or stationary web.

These and further objects of the present invention will be more readily perceived when considering the following disclosure and appended drawings wherein FIG. 1 is a perspective view, partially in section, illustrating the basic components of the ion plasma electron gun;

SUMMARY OF THE INVENTION

The present invention employs an ion plasma electron gun assembly comprising an electrically conductive evacuated housing forming first and second chambers adjacent to one another and having an opening therebetween. Means are provided for generating a plasma of electrons and positive ions in a first chamber. A cathode is positioned in a second chamber in a spaced and insulated relationship from the housing. The cathode is provided with a secondary electron emissive surface. Means are provided for applying a high negative voltage between the cathode and the housing to cause the cathode to draw positive ions from the first chamber to the second chamber to impinge on the surface of the cathode and to cause the secondary electron emissive surface to emit secondary electrons.

An electrically-conductive electron transmissive foil extends over an opening in the housing at the end of the first chamber facing the cathode. The foil is electrically connected to the housing to constitute an anode for the secodary electrons, which causes the secondary electrons to pass through the foil as an electron beam. An electrically-conductive extractor grid is generally mounted in the second chamber adjacent the secondary electron emissive surface of the cathode, which is connected to the housing to create an electrostatic field at the surface to cause secondary electrons to pass through openings in the grid and into the first chamber.

An electrically-conductive support grid is mounted in the first chamber adjacent to the foil which is connected to the foil and the housing. The support grid serves to support the foil and in conjunction with the extractor grid acts to accelerate the secondary electrons into the foil.

Means are provided for creating a pulse of secondary electrons. This is done by varying the period of time in which the secondary electrons are emitted through the foil. In doing so, the intensity of the secondary electrons emitted through the foil is maintained substantially constant while the fraction of time during which the secondary electrons are transmitted is varied. This creates a pulse such that a unit length of web material receives a dosage of secondary electrons which can be varied to control the total amount of energy irradiating the web surface while providing uniform beam intensity throughout the web surface.

DETAILED DESCRIPTION OF THE INVENTION

Figure 1:
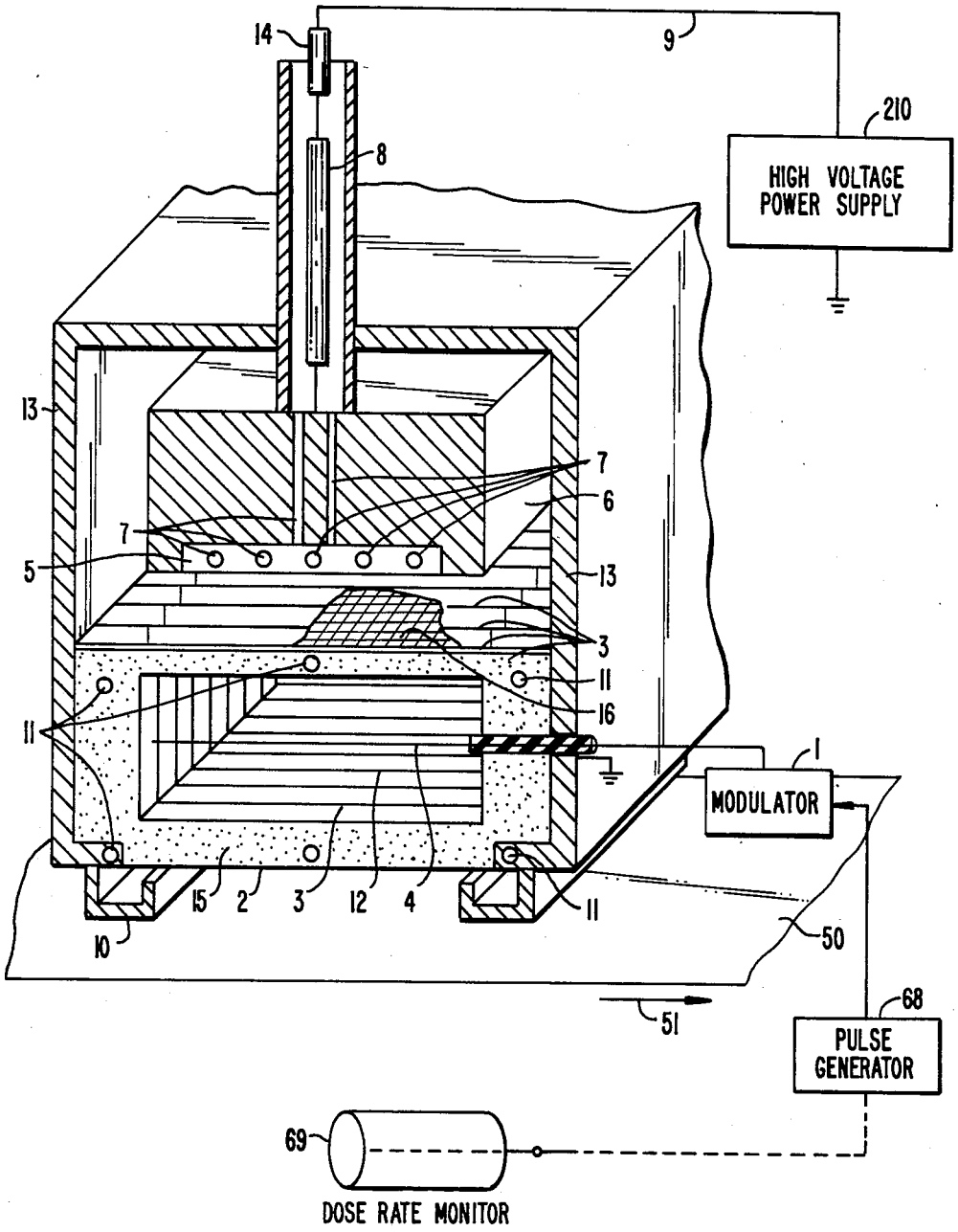

FIG. 1 illustrates the basic components of a plasma electron gun constructed in accordance with one embodiment of the present invention. The gun includes an electrically-conductive grounded enclosure which is composed of a high voltage chamber 13, an ion plasma discharge chamber 12, and an electron transmissive foil window 2. The wire 4 extends into or throughout plasma discharge chamber 12. The foil window is electrically connected to the grounded enclosure, and it forms an anode which causes electrons to be accelerated to and through it. The enclosure is filled to from one to 10 microns of helium. A oathode 6 is positioned in the high voltage chamber 13 and insulated therefrom. An insert 5 for the cathode is mounted on its lower surface. The insert 5 is typically molybdenum, but can be any material with a high secondary emission coefficient. The spacing between the cathode 6 and the enclosure is shaped to prevent Paschen breakdown of the electrical field.

A high voltage power supply 210 supplies a high negative potential of 150 to 300 kv to cathode 6 through cable 9, which extends through an epoxy insulator 14, to optional resistor 8 which is interposed between the cable 9 and the cathode 6. The cathode 6 and insert 5 are cooled by an appropriate cooling liquid, such as an oil, which is pumped through conduit 7.

The plasma chamber 12 contains a number of metallic ribs 3 which are mechanically and electrically connected together. The ribs 3 contain cutouts in the center to allow wire 4 to pass through the entire structure. The sides of the ribs 3 facing the cathode 6 form an extraction grid 16, or the opposing side of the ribs form a support grid 15 for supporting the electron transmissive foil window 2. Alternatively, extractor grids and anode plates can comprise sheets of metallic material with holes cut out therein. Liquid cooling channels 11 provide for heat removal from the plasma chamber.

The electron transmissive window 2 may be composed of a one quarter to one mil thick titanium or aluminum foil, which is supported by the support grid 15 and sealed to the enclosure by an O-ring. A gas manifold 10 is an optional expedient to cool the foil window with pressurized nitrogen, and to eliminate ozone from the beam area.

When modulated power supply 1 is energized, a plasma consisting of helium ions and electrons discharge is established in the plasma chamber 12 by the electric field surrounding wire 4. The modulator may be a direct current power supply, or a 20 to 30 MHz radio frequency generator. Once the plasma is established, the helium ions attracted to cathode 6 by the field that leaks through the extraction grid 16 onto the plasma chamber. This field can vary in strength from a few hundred volts up to 10,000 volts. The ions flow along the field lines through the extraction grid 16 into the high voltage chamber 13. Here they are accelerated across the full potential and bombard the cathode insert 5 as a collimated beam. The secondary electrons emitted by the cathode, being of negative charge, are attracted toward the anode, forming the desired electron beam for transmission to web 50.

The electron beam transmitted through foil window 2 impinges upon web 50 moving in direction of arrow 51. It is oftentimes desirable to be in a position to control the total amount of energy provided by the secondary electrons in curing or otherwise irradiating a specific unit length of moving web 50 or a stationary web in a specific unit of time. As previously noted, prior to the present invention, this could only be done by either mechanically varying the grid between the plasma chamber and the high voltage emitting electrode, which requires physical modification of the wire ion plasma device, or by changing the intensity of the plasma discharge and thus the helium ion current. However, when experiments were performed to stabilize the output beam intensity by varying the intensity of the plasma current more than a factor of 3, up or down, the result was a significant undesirable change in the beam uniformity. This is obviously unacceptable, for the moving or stationary web would tend to cure non-uniformly across its width.

The present invention provides a highly desirable solution to the problem of varying the dose rate of secondary electrons impinging upon moving or stationary web 50 while maintaining uniformity over the entire surface of the web. This is accomplished by providing a pulse-width modulation scheme in which the instantaneous beam intensity is maintained constant but the fraction of time during which the beam is emitted is varied. The minimum duration of a beam pulse is determined by the time needed to form a plasma throughout the plasma chamber. For example, at a helium pressure of 20 microns, and at a maximum or "striking" voltage of 1500 volts with an anode region dimension of several inches along the anode wire, the time needed to form a plasma throughout the plasma chamber is about 50 microseconds. In the case of a moving web the maximum duration of the modulation time period is determined by the transit time of the web material 50. Although the dose rate is a matter of design choice and is dppendent upon the material to be irradiated as well as the total energy needed for cure, it is suggested that under most circumstances, adequate uniformity of irradiation can be obtained if the web is exposed for at least ten modulation time periods during transit beneath the foil window. Continuing with the illustration, if one were to select a web speed of 1000 feet per minute while employing a teninch foil window length, the transit time will be 50 milliseconds. The pulse period could then be chosen as five milliseconds. Varying the pulse duration from a minimum of 50 microseconds to a fully "on" condition would thus adjustably vary the delivering dose over a range of 100 to 1. Obviously, one can achieve a wider dynamic range by using a longer window and/or a slower web speed.

Variables which determine the operation of the device of the present invention to provide the required dosage of secondary electrons include intensity of the output beam web speed and desired dose or quantity of irradiation necessary to cure or otherwise act upon the web.

There are a number of prior art means for monitoring the intensity of the output beam of an electron beam generator and no attempt will be made herein to describe said monitoring means as they do not constitute disclosure of the present invention. These monitors can be a direct interception dose rate monitor or an X-ray dose rate monitor. However, once measurement of the instantaneous beam intensity is made, one can determine the duty factor for the web which merely constitutes the ratio of energy which would be provided when the electron beam was to be on in a pulse mode to the energy which would be provided if the electron beam were to be provided continuously to the surface of the moving web.

Figure 2:
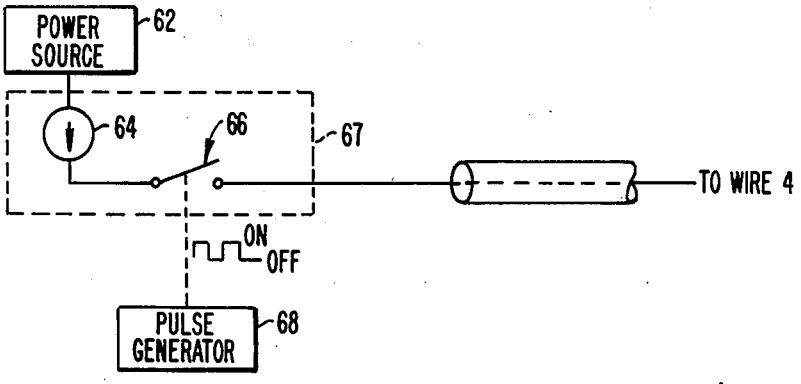
FIG. 2 is a simplified functional block schematic diagram of the basic components necessary to create a pulse-width modulation of the secondary electron discharge from the wire ion plasma device of the present invention.

Referring to FIG. 2, there is shown a conceptual diagram of the pulse modulated plasma current supply for wire 4 of the plasma electron gun. A power source supplies power to a current generator 64. Switch 66 is controlled by pulse generator 68 to open and close the connection between current generator 64 and wire 4. Current generator 64 and switch 66 collectively form modulated power supply 1.

Pulse generator 68 is set by the user to provide a designated duty cycle pulse train. The pulse train is a periodic signal, each period of which has an ON condition for a predetermined portion of the period and an OFF condition for the remainder of the period. The ratio of the time ON versus the time of the full period is known as the duty cycle or duty factor of the pulse train. As discussed above, the duty cycle of the pulse train is selected to provide a desired dose to the web 50.

Figure 4:
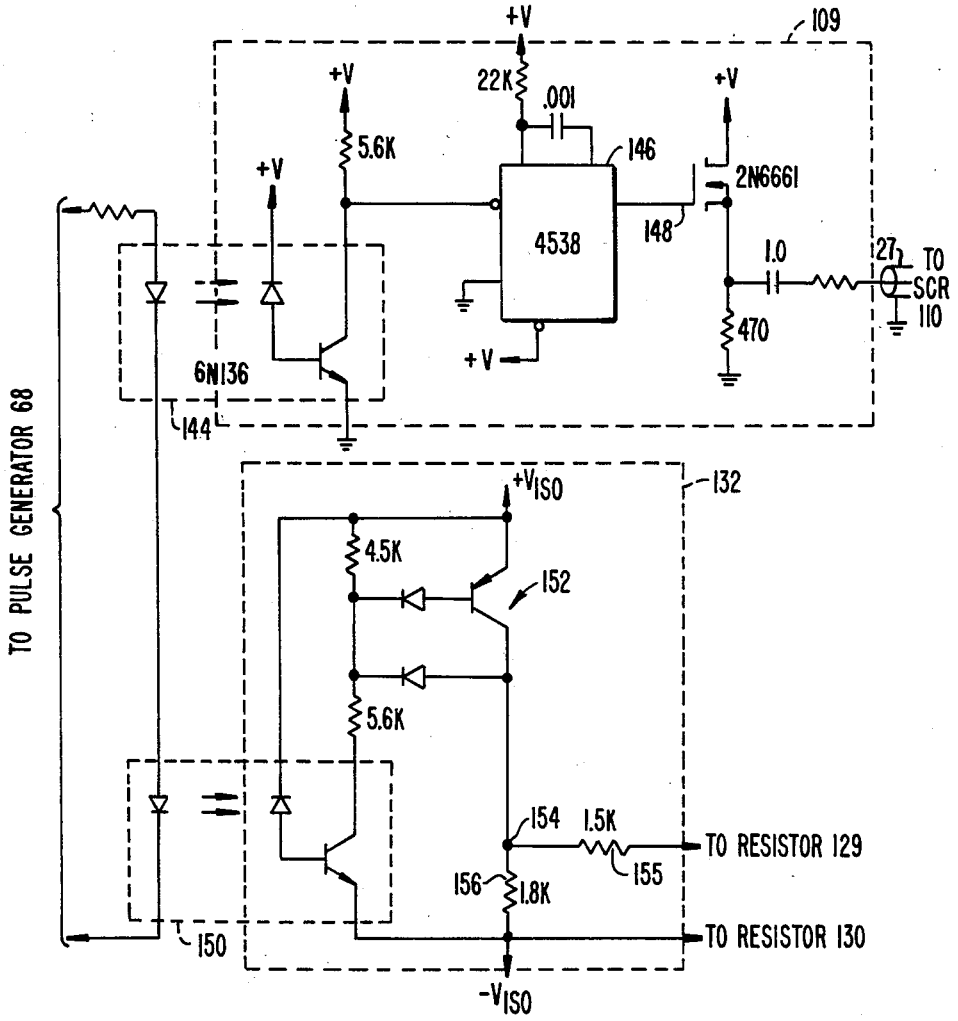
FIG. 4 is a detailed schematic diagram of circuitry employed in the preferred embodiment of the present invention as an interface between the pulse width generator and the power supply.
Figure 3:
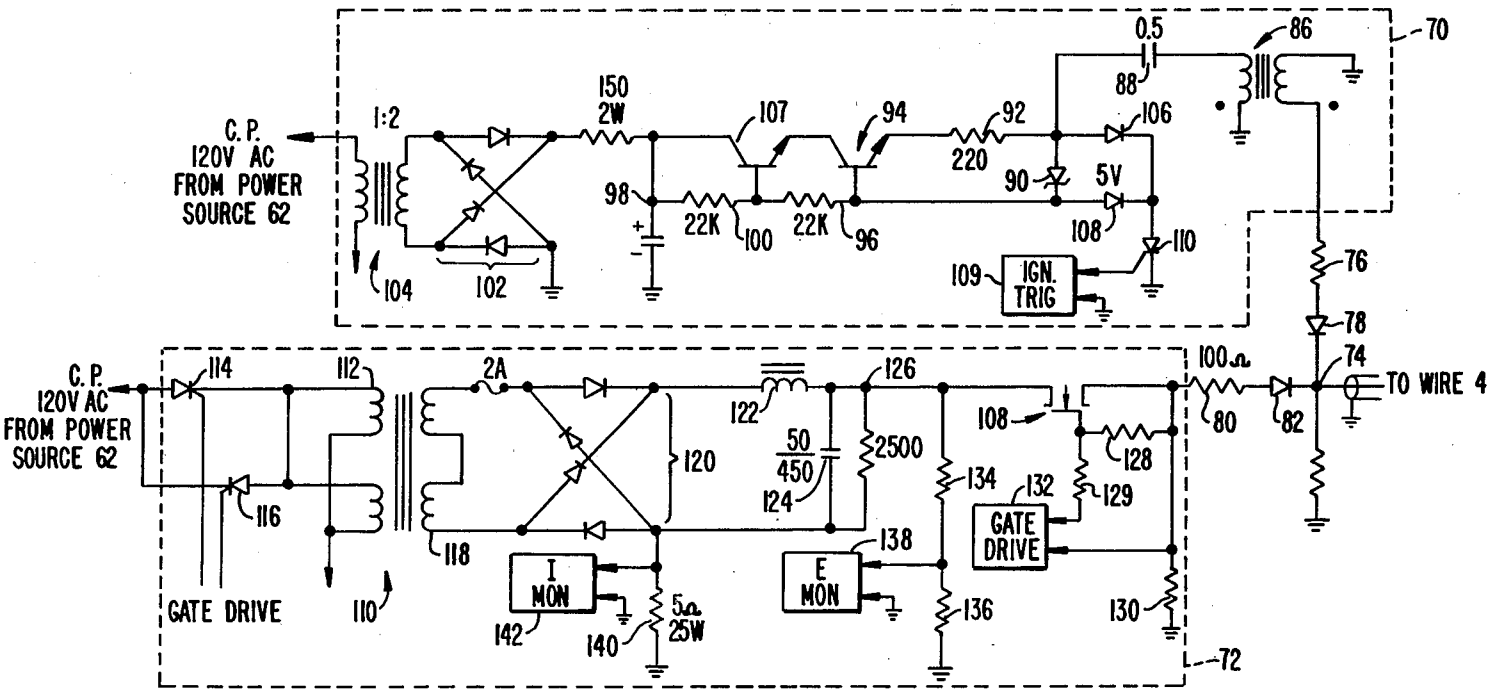
FIG. 3 is a detailed schematic diagram of one embodiment of a power supply which can be employed in the present invention.

Referring more specifically to FIGS. 3 and 4, a more detailed description of the implementation of the functions of current source 64 and switch 66 will be discussed. Pulse generator 68 can be any one of a number of pulse generators which can provide pulse trains with adjustable duty cycles, for example Model 100A of Systron Donner Corporation of Concord, Calif.

FIG. 4 illustrates circuitry included in modulated power supply 1 for interfacing with pulse generator 68.

Referring now to FIG. 3, modulated power supply 1 will be described in greater detail. In the preferred embodiment of the present invention current source 64 should supply a pulse which has an initial high voltage spike followed by a sustaining level of a designated duration. For example, the high voltage spike, or trigger pulse, can have a voltage of about 2,000 volts while the sustaining portion can have a level of approximately 400 volts. Such a waveform characteristic can be obtained by combining a trigger pulse from a trigger supply 70, with a sustaining voltage from a sustaining voltage supply 72. These two supplies convert power from power source 62, which for the circuitry of FIG. 3 would supply 120 volt alternating current power. The trigger pulse and sustaining pulse are summed at node 74 by way of the combination of resistor 76 and diode 78. Resistor 76 receives the trigger pulse from trigger pulse circuit 70 and applies the signal to summing node 74 via diode 78. Diode 78 insures that current flow between trigger supply 70 and summing node 74 is into node 74 and not in the reverse direction and isolates trigger supply 70 from the signal generated by voltage supply 72. Similarly, resistor 80 and diode 82 couple the sustaining pulse signal from sustaining pulse power supply 72 into summing node 74 in one direction.

Generally, trigger pulse power supply 70 employs a step-up transformer 86 and capacitor 88 to generate the requisite voltage spike. During the generation of the voltage spike, capacitor 88 is supplied with a predetermined amount of current. This current is determined by Zener diode 90, resistor 92, and the base emitter junction of transistor 94. As can be seen from FIG. 3, resistor 92 is connected between the emitter of transistor 94 and the cathode of Zener diode 90. The anode of Zener diode 90 is connected to the base of transistor 94. In this manner, Zener diode 90 determines the voltage drop across resistor 92. In turn, this sets the current level flowing through resistor 92.

Base drive to transistor 94 is supplied through resistor 96, which is connected to the rectified power at node 98, via resistor 100. The rectified power is supplied through a full wave diode bridge 102 which rectifies alternating current from the secondary of a 1:2 step-up transformer 104. The primary of step-up transformer 104 is connected to power source 62, which in this example, is the 120 volt alternating current source.

Transistor 107 has its emitter tied to the collector of transistor 94, its base tied to the junction between resistors 96 and 100, and its collector tied to node 98. Transistor 107 operates to handle a portion of the voltage which would otherwise be applied to the collector base of transistor 94 when trigger pulse supply 70 is triggered into an OFF condition. This permits transistors having lower breakdown voltages to be used, rather than a single, more expensive, high voltage transistor.

Turning to the explanation of the mechanism by which capacitor 88 and step-up transformer 86 generate the high voltage spike, diodes 106 and 108, along with SCR 110, operate to control the charging and discharging of capacitor 88. SCR 110 is turned off and on by the ignition trigger circuit 109 shown in FIG. 4. FIG. 4 will be discussed in further detail hereinbelow.

When SCR 110 is in an OFF condition, diodes 106 and 108 are reverse biased and capacitor 88 charges through transistors 94 and 107, resistor 92, and Zener diode 90. When capacitor 88 reaches its charged voltage, transistors 94 and 106 turn off. When SCR 110 is in an ON condition, diodes 106 and 108 are in a forward biased conducting condition, which keeps transistors 94 and 106 off, and discharges capacitor 88 through primary winding 86.

As can be seen from FIG. 3, step-up transformer 86 is polarized, as indicated by the dots at two of the terminals thereof, so that whenever capacitor 88 is discharging, a high voltage spike is induced at the secondary winding of step-up transformer 86. The terminal of the secondary of transformer 86 which is marked with a dot provides a positive-going high voltage potential to resistor 76 and diode 78. In this condition, diode 78 is forward biased and conducts so as to permit the high voltage to be applied to wire 4.

When capacitor 88 initially begins to charge, the voltage across t is small and the current through it is large. Recall that the current supplied to capacitor 88 is determined by the voltage drop across resistor 92. As capacitor 88 charges up, the voltage across it increases and the current through it decreases. Because, in this situation, current through primary winding of transformer 86 flows into the undotted terminal, a negative going signal is induced in the secondary. This causes diode 78 to be reverse biased, and none of the signal is applied to node 74.

When SCR 110 is in an ON condition, capacitor 88 discharges through the primary of transformer 86. This discharge causes a positive going voltage spike to be induced across the secondary winding of transformer 86. This waveform has a very rapid rise time to a high voltage, for example, 2,000 volts, and then a slightly more gradual decay in voltage towards zero volts. This spike causes diode 78 to be forward biased, so that the spike passes through to node 74.

Ringing in the primary of step up transformer 86 allows SCR 110 to recover to its OFF condition. With capacitor 88 discharged, and SCR 110 in an OFF condition, transistors 94 and 107 are again placed in an ON condition Capacitor 88 is then charged as before in preparation for the next trigger pulse.

Turning to sustaining power supply 72, FIG. 3, there is shown a voltage source which can be connected and disconnected to resistor 80 by way of MOSFET switch 108. The voltage source employs a transformer 110 having a primary winding 112 connected to a pair of SCRs 114 and 116. The SCR pair can be switched on and off at appropriate rates to control the level of voltage present in the secondary winding 118 of transformer 110.

The secondary winding 118 is connected across a diode bridge 120 which provides full wave rectification of the alternating current signal from secondary winding 118. Inductor 122 and capacitor 124 filter the full wave rectified signal to supply a direct current voltage at node 126. The drain of MOSFET 108 is connected to node 126, and the source is connected to resistor 80. The gate of MOSFET 108 is connected to ground through resistor 128 and resistor 130. The gate is also connected to gate drive circuitry 132, which will be explained in detail in connection with FIG. 4. Finally, the junction of resistors 128 and 130 is also coupled to gate drive circuitry 132.

MOSFET 108 is an enhancement mode n-channel device such that a positive gate to source voltage will result in current flowing from the drain to the source thereof. Conversely, when the gate to source voltage approaches zero, MOSFET 108 turns off. As such. MOSFET 108 operates as a switch depending upon the gate to source voltage applied. In some cases MOSFET 108 will be servo controlled to flatten the plasma current during the pulse.

Gate drive circuitry 132 operates to apply the appropriate control signal to the gate source of MOSFET 108 so as to produce the sustaining pulse portion of the signal applied to wire 4.

Also shown in sustaining pulse power supply 72 are a resistor pair 134 and 136 which are coupled between node 126 and ground. These resistors operate as a voltage divider for providing a voltage which is a predetermined proportion of the voltage at node 126 to voltage monitor 138. In this manner the voltage level being provided by sustaining pulse supply 72 can be determined.

Similarly, a current sense resistor 140 is coupled between one junction of diode bridge 120 and ground. The voltage produced across current sense resistor 140 is proportional to the current being supplied by sustaining pulse supply 72. This voltage is supplied to a current monitor 142.

Figure 5:
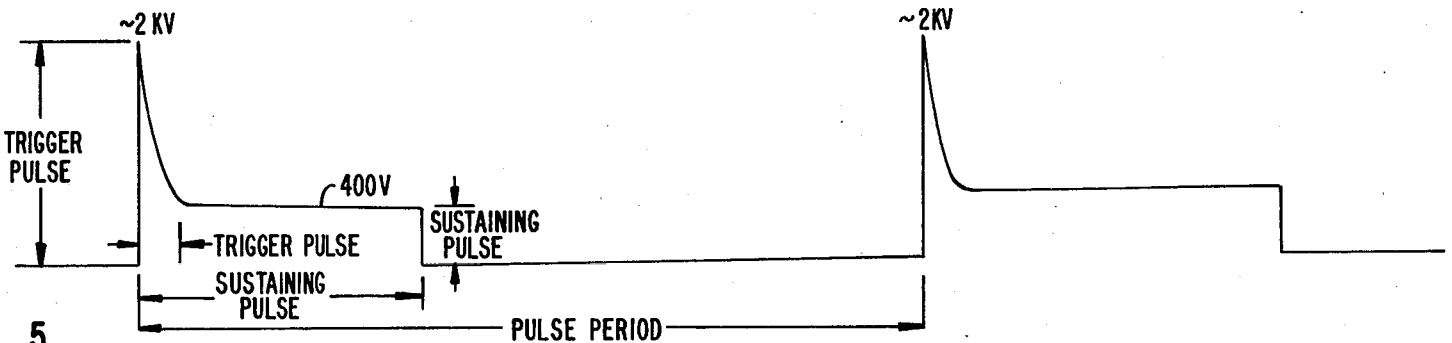
FIG. 5 illustrates a pulse train waveform which is generated by the circuitry of FIGS. 3 and 4.

As discussed earlier herein, the desired waveform for the plasma current is a series of pulses having a predetermined duty cycle, each pulse having an initial high voltage spike followed by a sustaining-pulse of a significantly lower constant voltage. FIG. 5 is a depiction of two periods of such a waveform. This waveform is present at node 74 of FIG. 3 and is a sum of the trigger pulse from trigger pulse supply 70 and the sustaining pulse from sustaining pulse supply 72. The operation of ignition trigger circuit 109 and gate drive circuit 132 should be synchronized so that the waveforms from each supply are generated in the proper sequence with respect to one another. This function is controlled by the interface circuitry of FIG. 4.

Referring now to FIG. 4, such circuitry is illustrated. Recall that in FIG. 1, pulse generator 68 drives modulated power supply 1 as a function of the current level measured by dose rate monitor 69. The circuitry of FIG. 4 provides the interface between pulse generator 68 and the trigger and sustaining power supplies of FIG. 3. A more detailed illustration of circuitry for ignition trigger 109 and gate drive 132 is provided in FIG. 4, enclosed in dotted lines.

More specifically, ignition trigger 109 employs a photo-optic link to receive signals from pulse generator 68. These signals drive a digital one-shot 146, which in turn operates a MOSFET 148. In turn, MOSFET 148 switches SCR 110 off and on in synchronism with the signal from pulse generator 68. Similarly, gate drive circuitry 132 receives signals from pulse generator 68 via photo-optical link 150. In turn, the received signals drive an inverter stage 152 which is coupled between an isolated pair of voltage supplies. When the waveform from pulse generator 68 goes positive, inverter 152 causes node 154 to become more positive. Node 154 is coupled to the gate of MOSFET 108 through resistor 155 and resistor 129. See FIG. 3. Resistor 156 is coupled between node 154 and the negative isolated supply, as shown in FIG. 4. The junction between resistor 156 and the negative supply, in turn, is connected to the junction between resistors 128 and 130 shown in FIG. 3. In this configuration, when node 154 goes positive, a positive voltage is induced across resistor 128, and thus across the gate source of MOSFET 108. This causes MOSFET 108 to turn on.

Conversely, when the signal from pulse generator 68 is a logic zero, invertor 152 ceases to conduct. As such, the voltage at node 154 is determined only by signals from sustaining pulse power supply 72 in FIG. 3. This, in effect, results in zero volts being induced across resistr 128, and thus causes MOSFET 108 to turn off. In this manner, pulse generator 68 causes sustaining power supply 72 to be connected and disconnected from node 74.

As can be seen from FIG. 4, signals from pulse generator 68 are applied in common to photo-optical links 144 and 150, thus the control signals generated from ignition circuitry 109 and gate drive circuitry 132 are synchronized. In relation to switch 66 of FIG. 2, the common drive to photo optical links 144 and 150, and the operation of SCR 110 and MOSFET 108 in response thereto, are the functional equivalent of switch 66.

Photo-optic links 144 and 150 are employed to isolate the pulse generator from the pulse power supplies. This is also the reason for using isolated power supplies to power gate drive circuitry 132.

Figure 6:
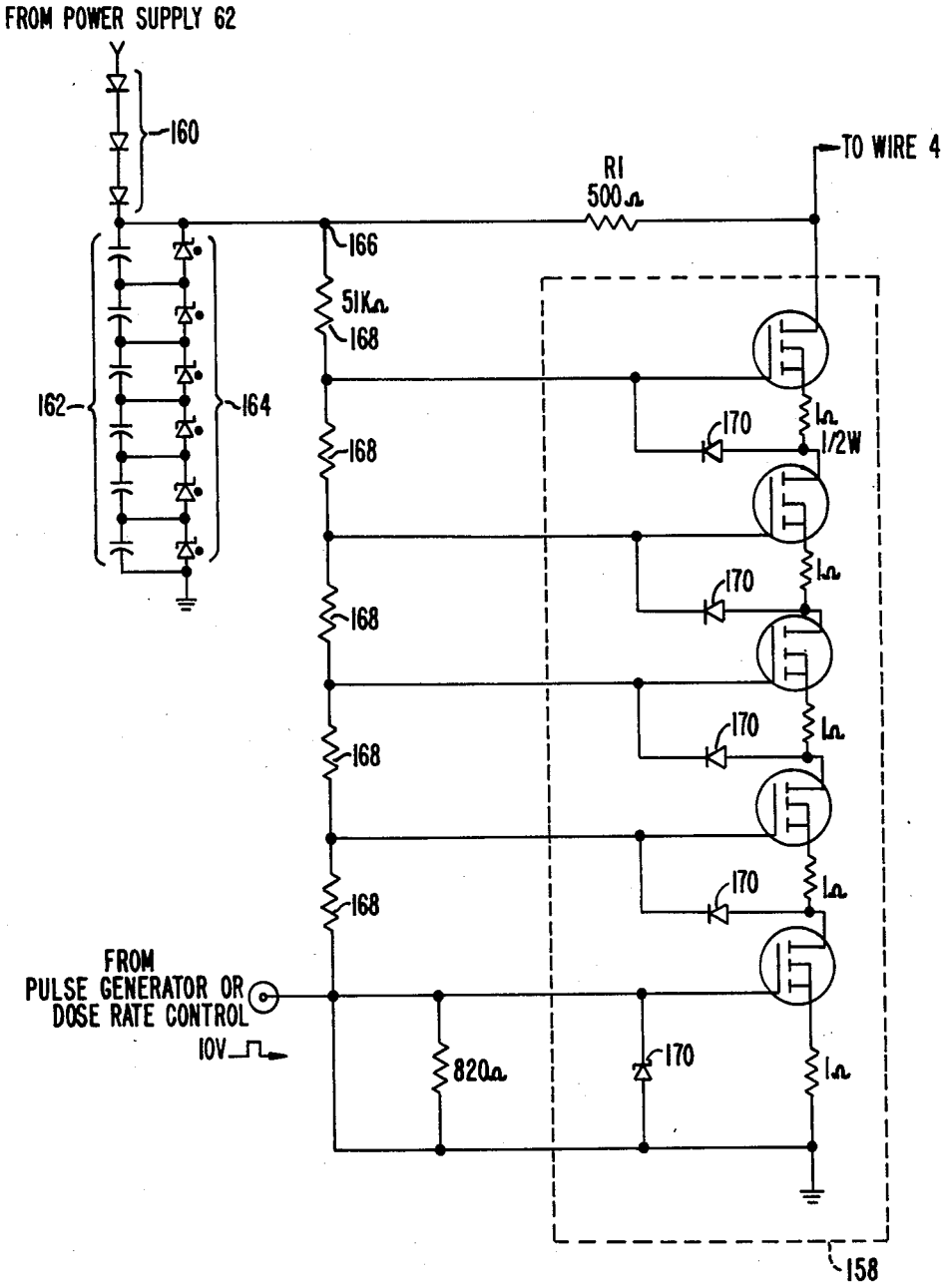
FIG. 6 is a simplified schematic diagram of a shunt regulator power supply which can be used as the sustaining power supply of the present invention.

Referring to FIG. 6, a shunt regulator is shown which can be used in place of the series regulator type circuitry 72. Here, a series connected array of MOSFET transistors 158 are connected in shunt between the output of the power supply and ground. The power supply is designed to provide the appropriate sustaining pulse voltage level. When the pulse has been applied for the desired amount of time, a controlling signal is supplied to the MOSFET structure 158 so that the structure shorts the output of the supply to ground. Series connected diodes 160 provide a half-wave rectified signal to filter capacitors 162. Zener diodes 164 regulate the voltage level present at node 166. Resistors 168 and Zener diodes 170 provide biasing to the MOSFET transistors in structure 158.

Figure 7:
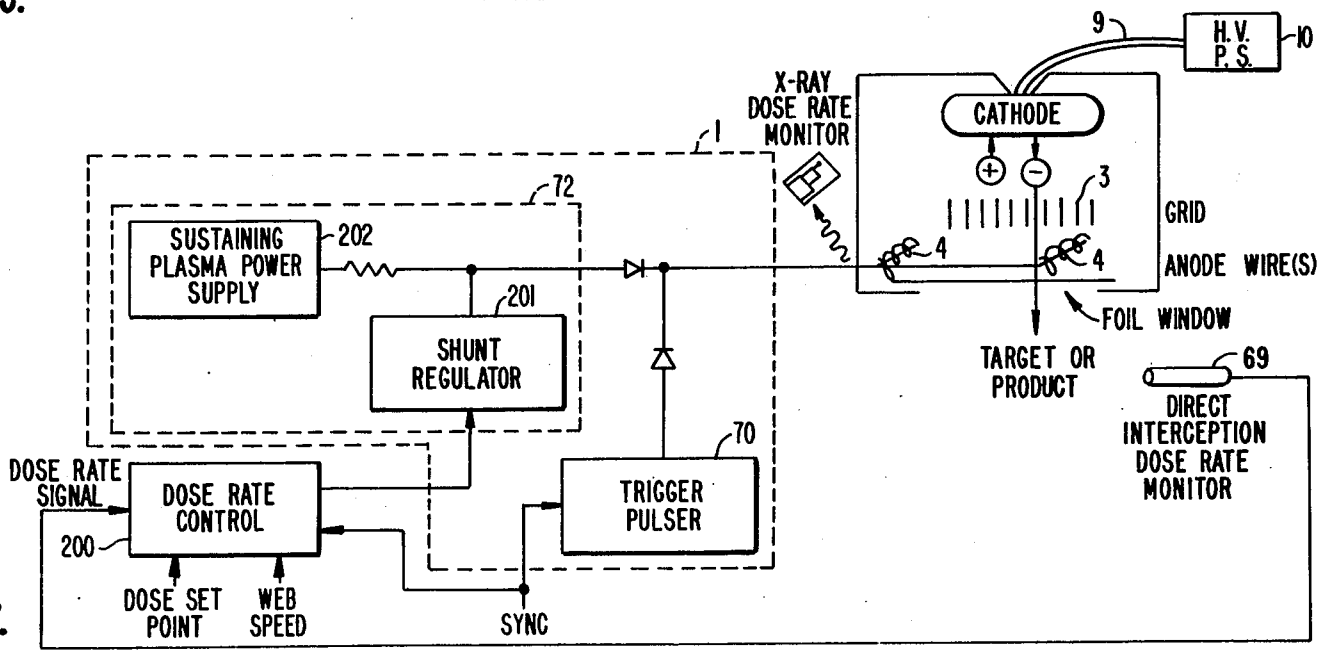
FIG. 7 is a simplified functional block diagram of an embodiment of the present invention which employs a servo-controlled configuration for closer control of the dose being applied.

The pulse width modulated plasma current supply, described hereinabove, can be embodied in a servo-controlled configuration to control more closely the dose applied by the ion plasma electron gun of the present invention. More particularly, reference is made to FIG. 7 in which such a configuration is shown in simplified functional form. FIG. 7 is similar to that shown in FIG. 1, except that the pulse generator 68 of FIG. 1 has been replaced by a dose rate control block 200 in FIG. 7, and that, in place of a series regulator, the shunt regulator 201 of FIG. 6 is used in conjunction with a sustaining plasma power supply 202.

In FIG. 1, the signal from dose rate monitor 69 is shown coupled to pulse generator 68 by a dashed line, indicating that the signal from the dose rate monitor 69 indirectly controls pulse generator 68. More particularly, based upon the signal, the user determines the proper pulse width for the desired dose, and sets pulse generator 68 accordingly.

In contrast, in the configuration of FIG. 7, the dose rate monitor signal is used as the feedback signal in a servo loop in which the dose rate control block 200 compares the dose rate signal to a dose rate set point and web speed to automatically set the pulse width for controlling the modulated power supply 1.

A sync signal is supplied simultaneously to trigger pulser 70 and to dose rate control 200. Trigger pulser 70 then issues the trigger pulse which starts the plasma. Dose rate control 200 maintains an input to sustaining supply 72, thus keeping sustaining supply on, until the integral of the dose rate signal exceeds the dose set point level. At this point, dose rate control 200 turns off the input to sustaining supply 72, thus causing the plasma pulse to terminate.

Figure 8:
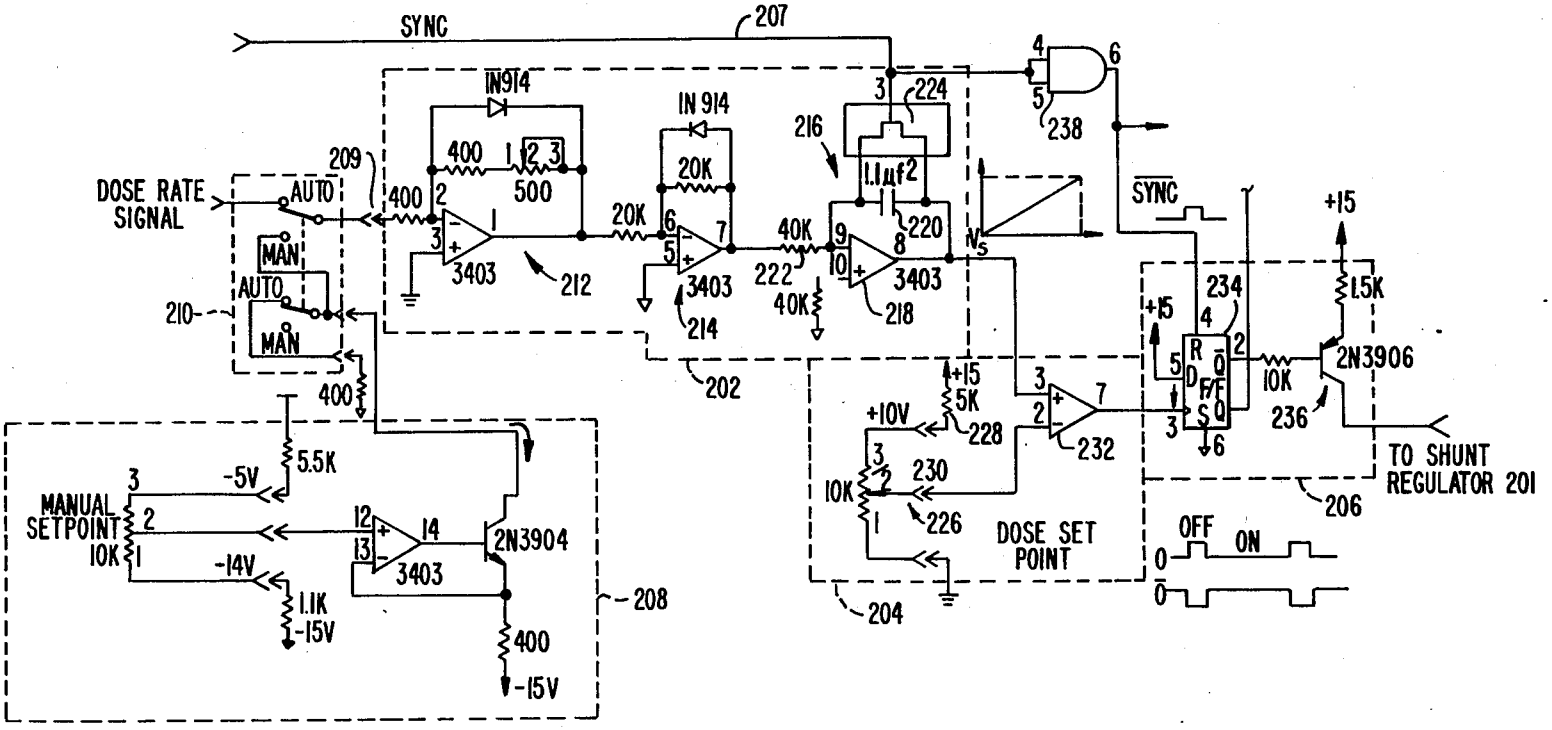
FIG. 8 is a more detail schematic diagram of the dose rate control block circuitry.

FIG. 8 is a more detailed schematic diagram of the circuitry of the preferred embodiment of the dose rate control block 200. Illustrated is circuitry for an integrator 202, a comparator 204, and a pulse forming circuit 206. Integrator 202 receives a dose rate signal from dose rate monitor 69 and integrates it. The output of integrator 202 is compared against an e-beam integration threshold by comparator 204. The e-beam integration threshold is also referred to herein as the dose set point. When the e-beam integration threshold is exceeded by the integrated dose rate signal, thus indicating the proper dose has been supplied for the current period, comparator 204 provides a signal to pulse forming circuit 206 to order the modulated power supply 1 into an OFF condition.

A clock circuit (not shown) provides the sync signal on line 207 to integrator 202 and to pulse forming circuit 206 in order to initiate the beginning of each period of the pulse train. This sync signal is simultaneously supplied to trigger pulser 70. Integrator 202 responds to the sync signal by reinitializing its state to zero. Pulse forming circuit 206 responds by resetting its state so as to order the modulated power supply 1 into an ON condition.

Under circumstances where open loop operation is desired, the dose rate signal can be supplied manually to integrator 202. Manual set point circuit 208 is shown in FIG. 8 which operates as an adjustable current source which is connectable to the input 209 of integrator 202 by way of switch 210. Switch 210 has first and second positions, the first of which causes the signal from dose rate monitor 69 to be connected to input 209 of integrator 202. In the second position, the manual set point circuit 208 is connected to input 209 of integrator 202.

Each of the above described functional blocks of FIG. 8 will now be described in greater detail. Integrator 202 includes a gain stage 212, which accepts the dose rate signals and amplifies it. An inverting buffer stage 214 corrects the polarity of the signal from the gain stage 212.

The actual integration occurs in integration stage 216 which operates on the signal from inverting buffer stage 214. Integration stage 216 includes an amplifier 218 having a capacitor 220 connected between its output and inverting input. The non-inverting input is coupled to signal common. The signal from inverting buffer stage 216 is applied to the inverting input of amplifier 218 by way of resistor 222. A MOS switch 224 is connected in shunt across capacitor 220 so that the voltage across capacitor 220 can be set to zero in response to the sync signal, when a new integration operation is desired.

Comparator 204 includes an adjustable voltage divider circuit 226 which generates the e-beam integration threshold signal. More specifically, a fixed resistor 228 and a variable resistor 230 are connected in series and divide-down the supply voltage to the a voltage representative of the desired threshold level. By manipulating the variable resistor 230, the user can vary the voltage generated.

The e-beam integration threshold signal is applied to the inverting input of a comparator 232. The integrated dose rate signal is applied to the non-inverting input of comparator 232. When the integrated dose rate signal exceeds the e-beam integration threshold, indicating that the desired dose has been delivered, comparator 232 provides a logic one output level to pulse forming circuit 206. Conversely, when the integrated dose rate signal is less than the e-beam integration threshold, comparator 232 provides a logic zero output level.

Pulse forming circuit 206 includes a D flip flop 234 and a follower-driver stage 236. The signal from comparator 232 is applied to the clock input of flip flop 234. The D-input of flip flop 234 is tied to a logic one level, and the inverted output of flip flop 234 drives follower-driver stage 236.

The reset input of D flip flop 234 receives the compliment of the sync signal of line 207 via inverter 238. Recall that the sync signal is also supplied to the control terminal of MOS switch 224 and operates to discharge capacitor 220 when a new integration operation is to begin. Thus, when the sync signal goes from a logic one state in which switch 224 is on, to a logic zero state in which switch 224 is off and capacitor 220 is charging, D flip flop 234 is reset.

When D flip flop 234 is reset, its inverting output will be at a logic one and follower-driver 236 signal modulated power supply 1 to initiate the energizing pulse. In a further embodiment of the modulated power supply 1 of the present invention, the trigger pulser 72 and sustaining supply 70 of FIG. 7 could be replaced by a current regulated supply having a maximum voltage corresponding to that required for the trigger pulse. The current regulated supply would be used in the position of the sustaining plasma power supply 202 of FIG. 7, in conjunction with shunt regulator 201. When the shunt regulator 201 of FIG. 7 is turned off the current regulated supply ramps toward its maximum voltage level until the plasma discharge is formed. Thereafter, the current regulated supply adjusts to feed the preset current at a lower sustaining voltage level.

The above causes a beam to be generated and a dose delivered to the target or product. The dose rate monitor 69 measures the dose being applied and supplies a dose rate signal representative thereof to the dose rate control block 200. Integrator 218 in dose rate control block 200 integrates this signal and supplies the integral to comparator 204. When the integral exceeds the e-beam integration threshold, comparator 204 supplies a positive going clock pulse to D flip flop 234. This causes D flip flop 234 to store the logic state presented at its D input, in this case a logic one, and to provide a logic zero at its inverting output. In turn, follower-driver 235 provides a signal to shunt regulator 200 to cause it to turn on. The shunt regulator 200 diverts the current which had been sustaining the plasma discharge. The plasma disappears and the electron beam ceases. This terminates the pulse for the pulse period. The above is repeated in the next pulse period.

In the above manner, a servo controlled system is provided.

We claim:

1. In an ion plasma electron gun assembly comprising: an electrically conductive evacuated housing forming first and second chambers adjacent to one another and having an opening therebetween; means for generating positive ions in said first chamber; a cathode positioned in said second chamber in spaced and insulated relationship from said housing, said cathode having a secondary electron emissive surface; means for applying a high negative voltage between said cathode and said housing to cause said cathode to draw the positive ions from said first chamber to said second chamber to impinge on said surface of said cathode and to cause said surface to emit secondary electrons; an electrically conductive electron transmissive foil extending over an opening in said housing at the end of said first chamber facing said cathode, said foil being electrically connected to the housing to constitute an anode for the secondary electrons and causing the secondary electrons to pass through the foil as an electron beam; an electrically conductive extractor grid mounted in said second chamber adjacent to the secondary electron emissive surface of said cathode and connected to said housing to create an electrostatic field at said surface to cause secondary electrons therefrom to pass through the openings in the grid and into said first chamber; and an electrically conductive support grid mounted in said first chamber adjacent to said foil and connected to said foil and to said housing, said support grid serving to support said foil and to act in conjunction with said extractor grid to accelerate the secondary electrons to the foil, the improvement comprising providing means for creating a pulse of secondary electrons by varying the period of time in which the secondary electrons are transmitted through the foil, by varying the power supply for said means for generating positive ions between on and off conditions to pulse the output of said secondary electrons.

2. The ion plasma electron gun of claim 1 wherein the intensity of the secondary electrons transmitted through the foil is maintained substantially constant while the fraction of time during which the secondary electrons are transmitted is varied.

3. The ion plasma electron gun of claim 2 wherein said secondary electrons are caused to strike a stationary or moving web of material adjacent said foil window to be thus irradiated by said secondary electrons.

4. The ion plasma electron gun of claim 3 wherein the fraction of time during which the secondary electrons are transmitted and thus strike said stationary or moving web of material is varied to create a pulse such that a unit length of web material receives a dosage of secondary electrons adjustable over a range of 100 to 1 of the dosage which it would receive if the web material was to be continuously irradiated by said secondary electrons.

5. The ion plasma electron gun of claim 1 wherein the minimum pulse of secondary electrons is determined by the time needed to form a plasma throughout the plasma chamber.

6. A method for creating secondary electron from an ion plasma electron gun while varying the dosage of said secondary electrons striking a stationary or moving web of material to be irradiated by said ion plasma electron gun comprising:

an ion plasma electron gun assembly, which in turn comprises an electrically conductive evacuated housing forming first and second chambers adjacent to one another and having an opening therebetween; means for generating positive ions in said first chamber; a cathode positioned in said second chamber in spaced and insulated relationship from said housing, said cathode having a secondary electron emissive surface; means for applying a high negative voltage between said cathode and said housing to cause said cathode to draw the positive ions from said first chamber to said second chamber to impinge on said surface of said cathode and to cause said surface to emit secondary electrons; an electrically conductive electron transmissive foil extending over an opening in said housing at the end of said first chamber facing said cathode, said foil being electrically connected to the housing to constitute an anode for the secondary electrons and causing the secondary electrons to pass through the foil as an electron beam; an electrically conductive extractor grid mounted in said second chamber adjacent to the secondary electron emissive surface of said cathode and connected to said housing to create an electrostatic field at said surface to cause secondary electrons therefrom to pass through the openings in the grid and into said first chamber; and an electrically conductive support grid mounted in said first chamber adjacent to said foil and connected to said foil and to said housing, said support grid serving to support said foil and having openings therein preferably aligned with the openings in said extractor grid to act in conjunction with said extractor grid to accelerate the secondary electrons to the foil, while varying the period of time in which the secondary electrons are transmitted through the foil to create a pulse of said secondary electrons, by varying the power supply for said means for generating positive ions between on and off conditions.

7. The method of claim 6 wherein the intensity of the secondary electrons transmitted through the foil is maintained substantially constant while the fraction of time during which the secondary electrons are emitted is varied.

8. The method of claim 7 wherein the fraction of time during which the secondary electrons are transmitted through the foil and thus strike said stationary or moving web of material is variable from adjustable over a range of 100 to 1 of the dosage which it would receive if the web material was to be continuously irradiated by said secondary electrons.

9. The method of claim 6 wherein the minimum pulse of secondary electrons is determined by the time needed to form a plasma throughout the plasma chamber.

* * * * *